US008146723B2

(12) United States Patent
Harada

(10) Patent No.: US 8,146,723 B2
(45) Date of Patent: Apr. 3, 2012

(54) HYDRAULIC CONTROL APPARATUS FOR MARINE REVERSING GEAR ASSEMBLY FOR WATERCRAFT

(75) Inventor: Kazuyoshi Harada, Amagasaki (JP)

(73) Assignee: Yanmar Co., Ltd., Osaka (JP)

( * ) Notice: Subject to any disclaimer, the term of this patent is extended or adjusted under 35 U.S.C. 154(b) by 700 days.

(21) Appl. No.: 12/292,969

(22) Filed: Dec. 2, 2008

(65) Prior Publication Data

US 2009/0139226 A1 Jun. 4, 2009

(30) Foreign Application Priority Data

Dec. 4, 2007 (JP) ..... 2007-313862

(51) Int. Cl.

| | |
|---|---|
| ***B60W 10/10*** | (2012.01) |
| ***F16D 25/12*** | (2006.01) |
| ***F16D 21/00*** | (2006.01) |
| ***B63H 21/21*** | (2006.01) |

(52) U.S. Cl. ..... 192/3.58; 192/85.63; 192/48.601; 192/51; 440/86; 440/75

(58) Field of Classification Search ..... 440/86, 440/75; 192/3.58, 48.601, 51, 85.63
See application file for complete search history.

(56) References Cited

U.S. PATENT DOCUMENTS

| | | | | |
|---|---|---|---|---|
| 2,927,472 | A | 3/1960 | Grant | |
| 5,085,302 | A * | 2/1992 | Kriesels | 192/51 |
| 6,062,926 | A * | 5/2000 | Alexander et al. | 440/75 |
| 6,679,740 | B1 * | 1/2004 | Imanaka et al. | 440/75 |
| 7,364,483 | B2 * | 4/2008 | Harada et al. | 440/6 |
| 7,487,864 | B2 * | 2/2009 | Kohlhaas et al. | 192/3.58 |
| 7,631,740 | B2 * | 12/2009 | Leibbrandt et al. | 192/48.601 |
| 7,635,058 | B2 * | 12/2009 | Moehlmann et al. | 192/48.601 |
| 7,690,251 | B2 * | 4/2010 | Harada et al. | 73/290 R |
| 2004/0244232 | A1 * | 12/2004 | Toji | 37/348 |
| 2006/0073747 | A1 * | 4/2006 | Harada et al. | 440/75 |
| 2008/0026652 | A1 * | 1/2008 | Okanishi et al. | 440/75 |

FOREIGN PATENT DOCUMENTS

| | | |
|---|---|---|
| GB | 951038 A | 3/1964 |
| JP | U-06-78637 | 11/1994 |
| WO | WO 2005/007503 A1 | 1/2005 |

OTHER PUBLICATIONS

European Search Report issued from the European Patent Office on Mar. 30, 2009 in the corresponding European patent application No. 08020979.4-1254.

* cited by examiner

*Primary Examiner* — David D Le
*Assistant Examiner* — Lillian Nguyen
(74) *Attorney, Agent, or Firm* — Posz Law Group, PLC

(57) ABSTRACT

A hydraulic control apparatus for marine reversing gear assembly for watercraft includes a pressure-reducing valve for adjusting pressure of working oil supplied from a supply pump, and supplying working oil to forward and reverse clutches; a proportional electromagnetic valve for controlling the supply of working oil to a pilot chamber of the pressure reducing valve; and a spring-type switching valve for switching to a circuit for supplying working oil to a control piston chamber for controlling a spring force of the pressure-reducing valve or to a circuit for draining working oil from the chamber; wherein a pressure output from the proportional electromagnetic valve acts upon the switching valve as a pilot pressure; and, when the pilot pressure falls below a predetermined value, the switching valve switches to the circuit for supplying the working oil to the chamber via the spring of the switching valve, fully opening the pressure-reducing valve.

3 Claims, 9 Drawing Sheets

(a)

(b)

HYDRAULIC CONTROL APPARATUS FOR MARINE REVERSING GEAR ASSEMBLY FOR WATERCRAFT

BACKGROUND OF THE INVENTION (1) Field of the Invention

The present invention relates to a hydraulic control apparatus for marine reversing gear assembly for watercraft, and more particularly to a hydraulic control apparatus for trolling.

(2) Description of the Related Art

In recent years, the engine speeds for small watercraft such as small fishing boats, recreational fishing boats, and the like have increased (for example, to a speed of 4,000 rpm or higher). When traveling at very low speeds, such as when trolling or the like, the engine is required to run at low speed; however, driving a high-speed-type engine at low speed may cause hunting or engine stalling, making it impossible to drive the engine at the desired low speed. For this reason, the engine is driven at low speed by causing hydraulic clutches located between the engine and the output shaft to slip relative to each other when engaged (i.e., in a half-clutch condition). As an alternative, the provision of a multistage transmission or a continuously variable transmission to cover the range from low to high speeds can also be considered. The provision of such a transmission, however, increases the size of the control apparatus, and also increases the cost, and is therefore not suitable for small watercraft.

For reasons such as those set forth above, hydraulic clutch-type marine reversing gear assembly for watercraft have, for example, a pressure reducing valve referred to as a low-speed valve in a circuit for supplying a working oil to the hydraulic clutches, in order to travel at very low speeds, e.g., when trolling. This allows the pilot pressure to the low-speed valve to be controlled by a proportional electromagnetic valve that interlocks with a trolling lever, so as to control the number of revolutions of the propeller shaft to follow the instruction value from the trolling lever. On the other hand, the supply of the working oil to the proportional electromagnetic valve is turned on and off by an electromagnetic switching valve referred to as a direct-coupled electromagnetic valve. When the proportional electromagnetic valve is turned off, the low-speed valve is fully opened to cause the hydraulic clutches to be in full engagement, such that switching is performed between trolling and normal traveling. A hydraulic control apparatus for marine reversing gear assembly for watercraft as described above is disclosed in, for example, Japanese Unexamined Utility Model Publication No. 6-78637.

However, in order to control the proportional electromagnetic valve and direct-coupled electromagnetic valve simultaneously, it is necessary to execute the timing for switching the direct-coupled electromagnetic valve by using a complicated control program (software). This increases the cost of the control system that includes the controller.

Accordingly, an object of the present invention is to provide a hydraulic control apparatus for marine reversing gear assembly for watercraft by replacing a direct-coupled electromagnetic valve with a mechanical switching valve that does not require electronic control, thereby obviating the need for complicated electronic control to reduce the cost.

BRIEF SUMMARY OF THE INVENTION

In order to achieve the above-mentioned object, a hydraulic control apparatus for marine reversing gear assembly for watercraft in accordance with the invention includes a pressure reducing valve for adjusting the pressure of a working oil supplied from a working oil supply pump, and supplying the working oil to forward and reverse clutches; a proportional electromagnetic valve for controlling the supply of the working oil to a pilot chamber of the pressure reducing valve; and a spring-type switching valve for switching to a circuit for supplying the working oil to a control piston chamber for controlling a set spring force of the pressure reducing valve or to a circuit for draining the working oil from the control piston chamber; wherein a pressure output from the proportional electromagnetic valve acts upon the switching valve as a pilot pressure; and wherein, when the pilot pressure falls below a predetermined value, the switching valve switches to the circuit for supplying the working oil to the control piston chamber via the spring of the switching valve, thereby fully opening the pressure reducing valve.

In accordance with the invention, the electronic control is a control performed only by the proportional electromagnetic valve, such that the controller may only perform a simple current value control, thus enabling a cost reduction.

The hydraulic control apparatus may be configured so that, when the pilot pressure to the pilot chamber from the proportional electromagnetic valve is increased, the pressure of the working oil to the forward and reverse clutches is decreased by the pressure reducing valve.

The hydraulic control apparatus may also be configured so that, when an exciting current is not supplied to the proportional electromagnetic valve, the pilot pressure falls below the predetermined value, and the switching valve switches to the circuit for supplying the working oil to the control piston chamber via the spring, thereby fully opening the pressure reducing valve.

EXPLANATION OF REFERENCE NUMERALS

2*f* forward clutch
2*a* reverse clutch
21 proportional electromagnetic valve
22 pressure reducing valve
22*d* pilot chamber

22*t* setting spring
22*p* control piston chamber
23 switching valve
6 working oil supply pump

DESCRIPTION OF THE PREFERRED EMBODIMENTS

Marine reversing gear assembly for watercraft that include preferred embodiments of the hydraulic control apparatus of the invention are described below, with reference to FIGS. 1 to 11. Throughout the drawings, like numerals represent like elements.

Figure 1:
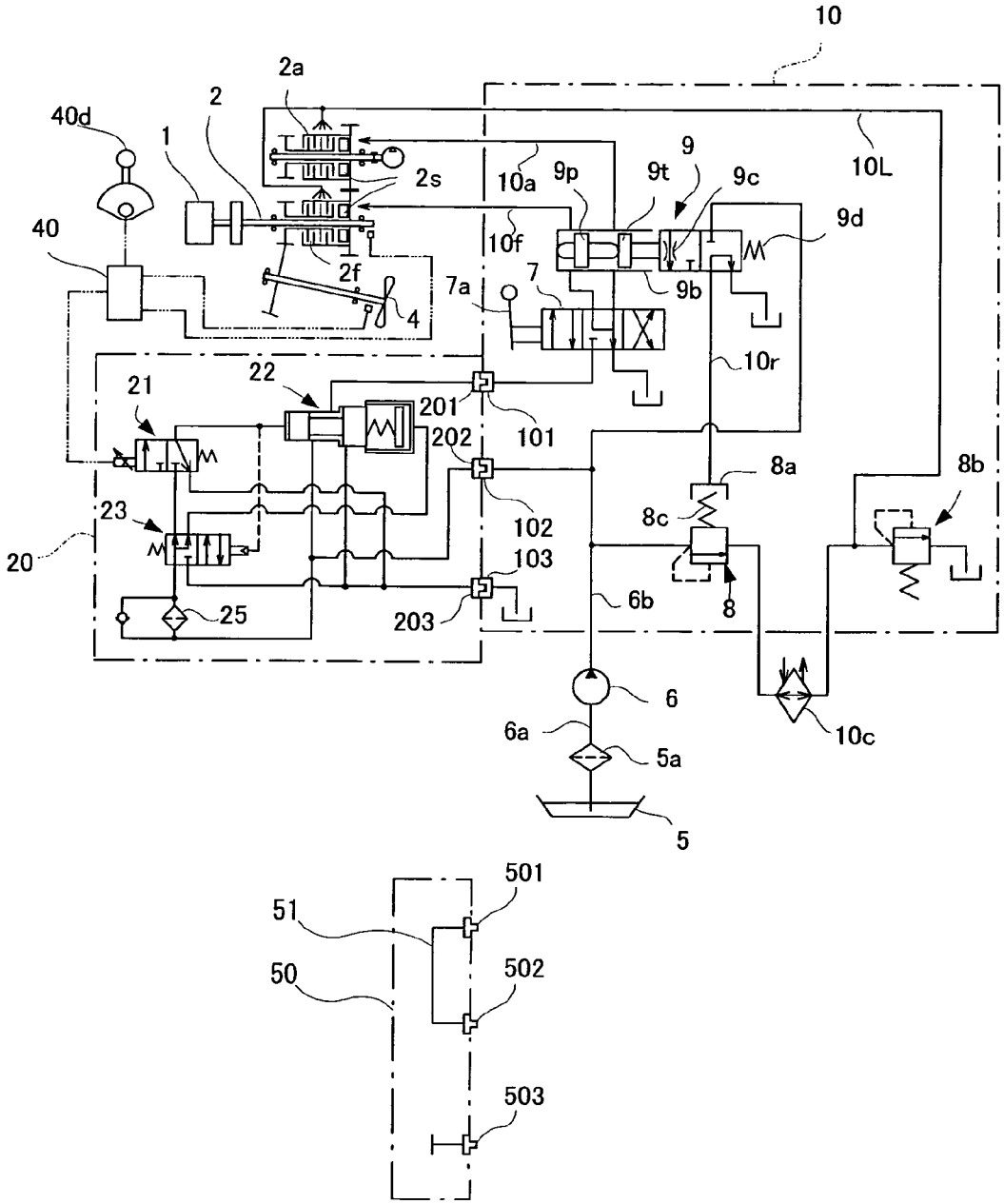
FIG. 1 is a hydraulic circuit diagram showing a hydraulic circuit of a reduction and reversing gear for watercraft that includes a preferred embodiment of the hydraulic control apparatus of the invention.

FIG. 1 shows a hydraulic circuit diagram of a reduction and reversing gear for watercraft. A forward clutch 2*f* and a reverse clutch 2*a* are located relative to the input shaft 2 that extends from the engine 1. The forward clutch 2*f* and reverse clutch 2*a* are each composed of alternately arranged friction plates and steel plates, although a detailed illustration thereof is omitted (see FIG. 8). The friction plates are connected to an inner gear (a pinion gear), and the steel plates are connected to an outer gear that is constantly rotating. By pressing these plates with each hydraulic piston 2*s*, the outer gear and inner gear rotate in conjunction. This causes rotation of the large gear 2*g* that is engaged with the inner gear, which in turn causes power to be transmitted from the large gear 2*g* via the propeller shaft 3 to the propeller 4.

Moreover, by adjusting the pressing force of each hydraulic piston 2*s*, the friction plates and steel plates slip relative to each other to cause a so-called half-clutch condition, thereby enabling trolling.

A working oil is supplied to these hydraulic pistons 2*s* via the oil circuits 10*f*, 10*a* of the working oil supply circuit 10. The working oil supply circuit 10 is equipped with a hydraulic control apparatus 20, which is referred to as a trolling device, for adjusting the pressure of the working oil. The hydraulic control apparatus 20 adjusts the pressure of the working oil supplied to the hydraulic pistons 2*s* to cause the above-described half-clutch condition, thereby making trolling possible.

The working oil supply circuit 10 of FIG. 1 is described first. The working oil supply circuit 10 has an oil tank 5, a filter 5*a*, a pump 6 connected to the filter 5*a* via an oil path 6*a*, and a forward/reverse switching valve 7. The working oil supplied by the oil pump 6 via the oil path 6*b* is fed via the port 102 to the hydraulic circuit in the hydraulic control apparatus 20.

The working oil adjusted in the hydraulic circuit is received via the port 101 again, and then passes through the forward/reverse switching valve 7 to be transmitted to the hydraulic pistons 2*s* via the oil circuits 10*f*, 10*a*. This causes the forward clutch 2*f* or reverse clutch 2*a* to actuate, causing either a forward or reverse torque to be transmitted to the propeller 4. Reference numeral 7*a* in FIG. 1 denotes a switching handle of the forward/reverse switching valve 7.

The working oil supply circuit 10 also contains a loose-fit valve 8 to prevent sudden contact between the forward and reverse clutches 2*f*, 2*a* when the forward/reverse switching valve 7 is switched. Reference numeral 10*c* denotes an oil cooler, and reference numeral 8*b* denotes a relief valve for setting the lubricating oil pressure.

The loose-fit valve 8 is a kind of a pressure adjusting valve, which is actuated by a two-position switching valve 9 that uses the hydraulic pressure of the forward oil circuit 10*f* or reverse oil circuit 10*a* in the working oil supply circuit 10. The two-position switching valve 9 has a cylinder 9*b*, pistons 9*p*, 9*t*, and a return spring 9*d*. When the pressure oil flows in the forward oil circuit 10*f* or reverse oil circuit 10*a* to increase the hydraulic pressure inside the cylinder 9*b*, either the piston 9*p* or 9*t* is shifted toward the right side of the figure to cause switching of the switching valve 9. This causes the working oil, whose flow rate has been controlled by the restrictor 9*c*, to flow, and the working oil is forced into the back chamber of the loose-fit valve 8 via the hydraulic circuit 10*r*. Then, after switching of the forward/reverse switching valve 7, the biasing force of the relief spring 8*c* is gradually increased via the control piston 8*a*, i.e., the pressure of the setting relief of the loose-fit valve 8 is gradually increased, until a predetermined time is reached, and, at the position where the biasing force of the spring 8*c* has maximized, the pressure reaches a level where the clutch 2*a* or 2*f* is fully engaged. When the hydraulic pressure is lost, the switching valve 9 returns to its original position by the biasing force of the return spring 9*d* to stop the flow of the working oil, and the control piston of the loose-fit valve 8 is reset to its original position.

That is to say, when the forward/reverse switching valve 7 is in the closed position (the position shown in FIG. 1), the two-position switching valve 9 is also in the closed position, such that the pressure oil is not supplied to the back chamber of the loose-fit valve 8. At this time, therefore, the spool of the loose-fit valve 8 is retracted to a large extent, and serves the same function as a relief valve with a low relief pressure. Part of the pressure oil supplied from the pump 6 via the oil path 6*b* is drained by the relief operation of the loose-fit valve 8, and is released to the lubricating oil path 10L via the oil cooler 10*c*.

Thus, the discharge pressure of the hydraulic pump 6 that reaches the port 102 is regulated by the loose-fit valve 8. The pressure of the working oil that exits from the port 101 is regulated by the hydraulic control apparatus 20, which is described in greater detail below.

The hydraulic pressure that is released to the lubricating oil path 10L from the loose-fit valve 8 is regulated to a predetermined low pressure by the relief valve 8*b* for setting the lubricating oil pressure.

When the forward/reverse switching valve 7 is then switched to a forward or reverse position by operating the handle 7*a*, the two-position switching valve 9 is also moved by the pistons 9*p*, 9*t*, utilizing the pressure of the working oil that begins to flow in the oil circuits 10*f*, 10*a* as the pilot pressure, thereby opening the oil path. Moreover, the flow rate is controlled by the restrictor 9*c* located in the two-position switching valve 9, such that the working oil is forced into the back chamber of the loose-fit valve 8 via the hydraulic circuit 10*r*. This in turn causes the spool to advance, causing the relief pressure to gradually increase, and the lubricating oil path 10L to gradually close. As its reflex action, the pressure of the working oil to the forward and reverse clutches 2*f*, 2*a* is gradually increased to prevent a sudden connection of the clutches. Then lastly, the clutches 2*a*, 2*f* are fully pressed at a high pressure to allow complete transmission of the power.

The above-described two-position switching valve 9 may also be an electromagnetic valve instead, although the illustration thereof is omitted. In this case, the actuation of the switching valve is controlled by a forward/reverse engagement sensor (not illustrated) that includes a contact switch, a pressure sensor, and the like, and interlocks with the forward/reverse operating lever 7*a*.

The hydraulic control apparatus 20 for trolling, which is attached to the working oil supply circuit 10, is described next.

Figure 2:
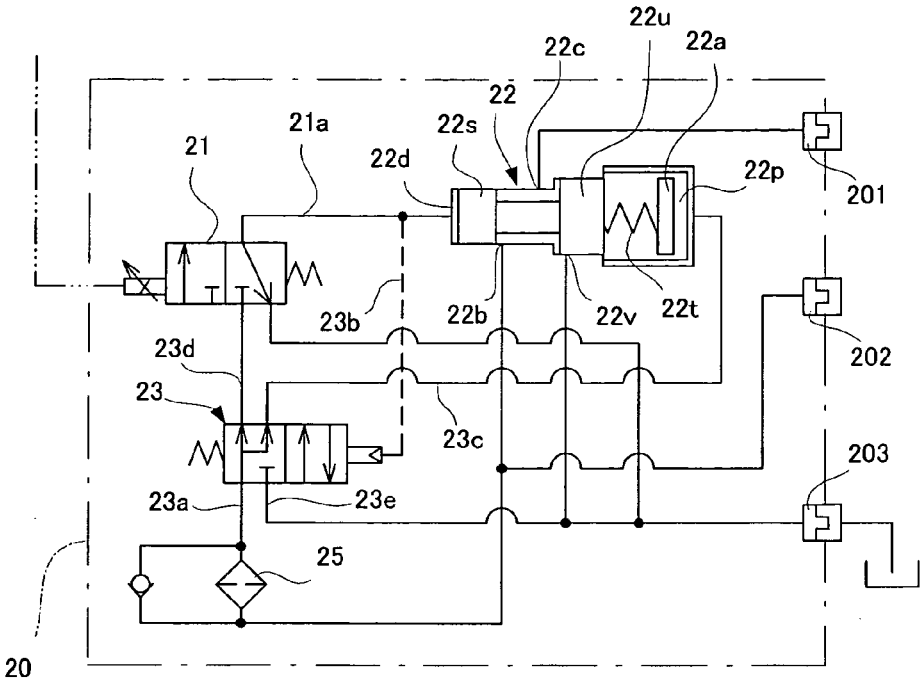
FIG. 2 is an enlarged hydraulic circuit diagram showing the operating state of the hydraulic control apparatus of FIG. 1.

As shown in FIGS. 1 and 2, the hydraulic control apparatus 20 includes a port 202 that is connected to the port 102 in the working oil supply circuit 10 to receive the working oil; a proportional electromagnetic valve 21; a pressure reducing valve 22 referred to as a low-speed valve; a switching valve 23; an oil filter 25; and a port 201 for draining the working oil from the pressure reducing valve 22 to the port 101 in the working oil supply circuit 10. The control apparatus 20 also includes a controller 40 to detect the number of revolutions of each of the input shaft 2 and propeller shaft 3, and set the slip amount of clutch, which is determined from the difference between the numbers of revolutions of these shafts, thereby setting the speed of the watercraft when trolling. Reference numeral 40*d* in FIG. 1 denotes a trolling lever for controlling the amount of slippage.

In the state shown in FIG. 2, the working oil fed from the pump 6 passes through the oil path 23*a*, switching valve 23, and oil path 23*c* to enter the control piston chamber 22*p* of the pressure reducing valve 22. This causes the control piston 22*a* to shift to the left from the position shown in FIG. 2, thereby fully opening the valve element 22*s* via the setting spring 22*t*. On the other hand, the valve element 22*u* blocks the drain port 22*v*, so that the pressure oil that has entered the input port 22*b* of the valve element 22*s* via the port 202 exits from the output port 22*c* via the port 201 without undergoing a pressure drop.

Figure 3:
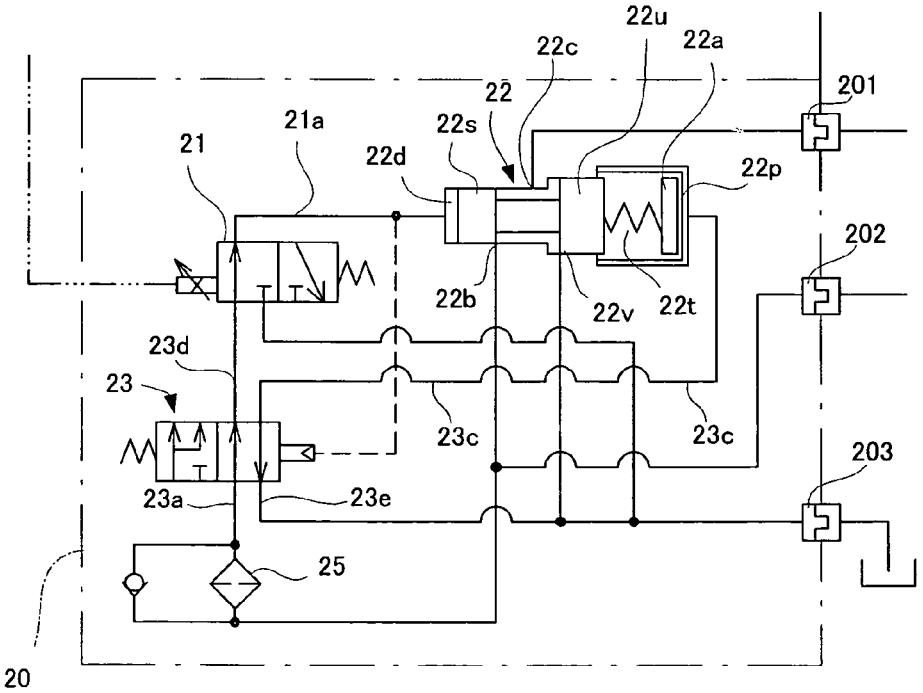
FIG. 3 is an enlarged hydraulic circuit showing another operating state of the hydraulic control apparatus of FIG. 1.
Figure 4:
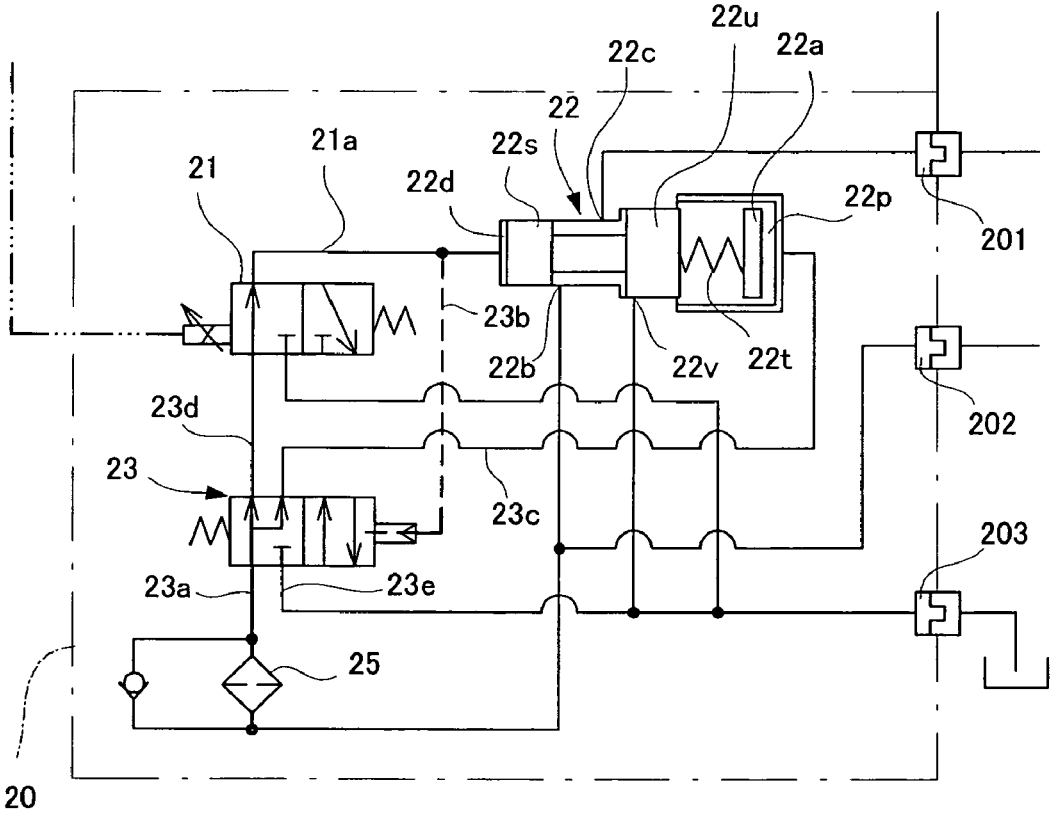
FIG. 4 is an enlarged hydraulic circuit diagram showing still another operating state of the hydraulic control apparatus of FIG. 1.

When an input signal for trolling is input, an exciting signal is output to the proportional electromagnetic valve 21 to cause the electromagnetic valve 21 to shift to the left-end port position shown in FIG. 3. The working oil passes through the switching valve 23, oil path 23*d*, proportional electromagnetic valve 21, and oil path 21*a*, and is supplied to the pilot chamber 22*d* of the valve element 22*s*. This causes a pilot pressure to be introduced into the pilot chamber 22*d* via the proportional electromagnetic valve 21. At the same time, the pressure output from the proportional electromagnetic valve 21 acts upon the switching valve 23 as the pilot pressure via the pilot oil path 23*b*. Thus, when the pilot pressure exceeds a predetermined value, the spring of the switching valve 23 is pushed by the pilot pressure to switch the switching valve 23 to the closed position shown in FIG. 3. This causes the working oil in the control piston chamber 22*p* to be drained from the port 203 via the oil path 23*c*, switching valve 23, and oil path 23*e*.

The pilot pressure introduced into the pilot chamber 22*d* of the pressure reducing valve 22 acts upon the valve element 22*s* to thereby control the degree of opening of the primary-side inlet port 22*b*. Then, the pressure oil that has entered the inlet port 22*b* of the valve element 22*s* via the port 202 undergoes a pressure drop by flow rate restriction, and exits from the outlet port 22*c* via the port 201. The amount of clutch slippage when trolling is determined according to the amount of operation of the trolling lever 40*d*. The controller 40 performs duty control on the proportional electromagnetic valve 21 according to the amount of operation.

Figure 5:
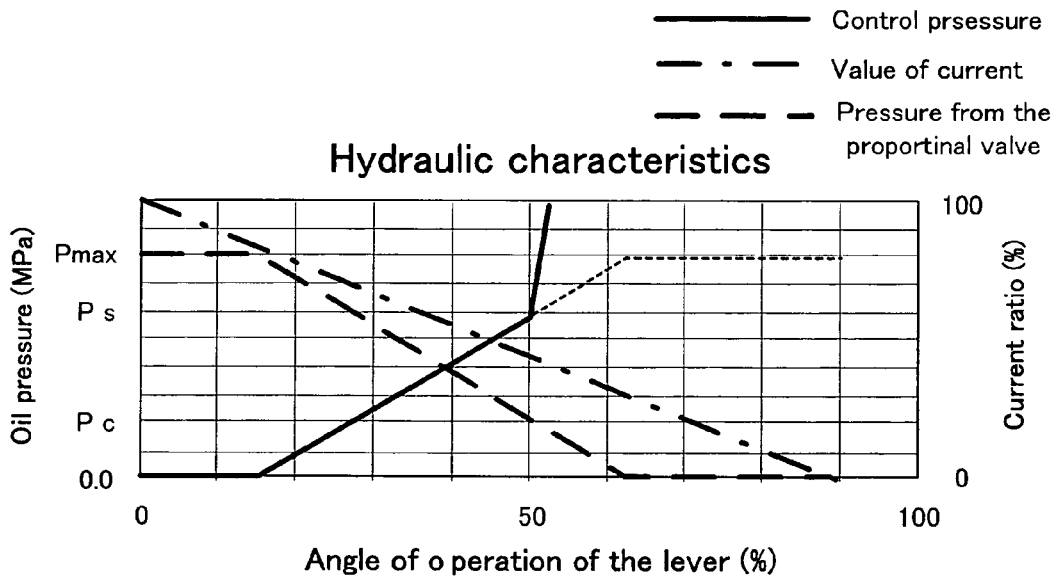
FIG. 5 is a graph showing the hydraulic characteristics of the hydraulic control apparatus of FIG. 1.

The oil pressure that is subjected to duty control enters the pilot chamber 22*d* of the pressure reducing valve 22 from the proportional electromagnetic valve 21. The valve element 22*s* of the pressure reducing valve 22 is thus pushed to the right shown in the figures, utilizing the difference between the areas of the pressing force of the setting spring 22*t* and the oil pressure, thereby narrowing the degree of opening of the inlet port 22*b*. In this way, an oil pressure that is inversely proportional to the pressure of the proportional electromagnetic valve 21 is output from the pressure reducing valve 22 as a control pressure. FIG. 5 shows the relationship between the pressure from the proportional electromagnetic valve 21 and the control pressure. In the example of FIG. 5, when the value of the exciting current (represented as a current ratio in FIG. 5) that is output from the controller 40 by operating the trolling lever 40*d* decreases, the pressure from the proportional electromagnetic valve 21 drops.

Referring to FIG. 5, when the angle of operation of the trolling lever 40*d* is from 0 to 50%, the sum of the pressure from the proportional electromagnetic valve 21 and the control pressure is constant, and is in proportion to the spring force of the setting spring 22*t*. When the angle of operation of the trolling lever 40*d* is more than 50%, the control pressure abruptly rises to a pressure at which the clutches are fully engaged (for example, 2 to 3 MPa).

This can be explained as follows. The pressure output from the proportional electromagnetic valve 21 acts as the pilot pressure upon the switching valve 23 via the pilot oil path 23*b*. When, however, the pilot pressure falls below a predetermined value (represented by Pc of FIG. 5), the spring force of the spring in the switching valve 23 surpasses the pilot pressure to switch the switching valve 23 to the open position shown in FIG. 4. This causes the working oil to be supplied to the control piston chamber 22*p* via the oil path 23*c* to increase the spring force of the setting spring 22*t*, causing the valve elements 22*u* and 22*s* to shift to the left side of the FIG. 4. As a result, the inlet port 22*b* is fully opened, and simultaneously the drain port 22*v* is closed, such that the control pressure abruptly rises from the predetermined value Pc to a pressure at which the clutches are fully engaged.

As described above, when the mechanical switching valve 23 is actuated by utilizing the secondary pressure from the proportional electromagnetic valve 21 as the pilot pressure, a complicated control program is unnecessary, thus enabling a cost reduction.

The switching valve 23 also functions as a safety device in the event of an emergency. For example, even if the power to the hydraulic control system fails for some reason, and the exciting current value of the proportional electromagnetic valve 21 becomes zero, the switching valve 23 is actuated to maximize the control pressure from the low-speed valve 22, causing the clutches to fully engage. As a result, the propeller shaft can be driven.

As described above, the pressure reducing valve 22 can reduce the pressure from the pressure at which the clutches are fully engaged, which is regulated by the loose-fit valve 8, to adjust the pressure to a range near zero.

Figure 6:
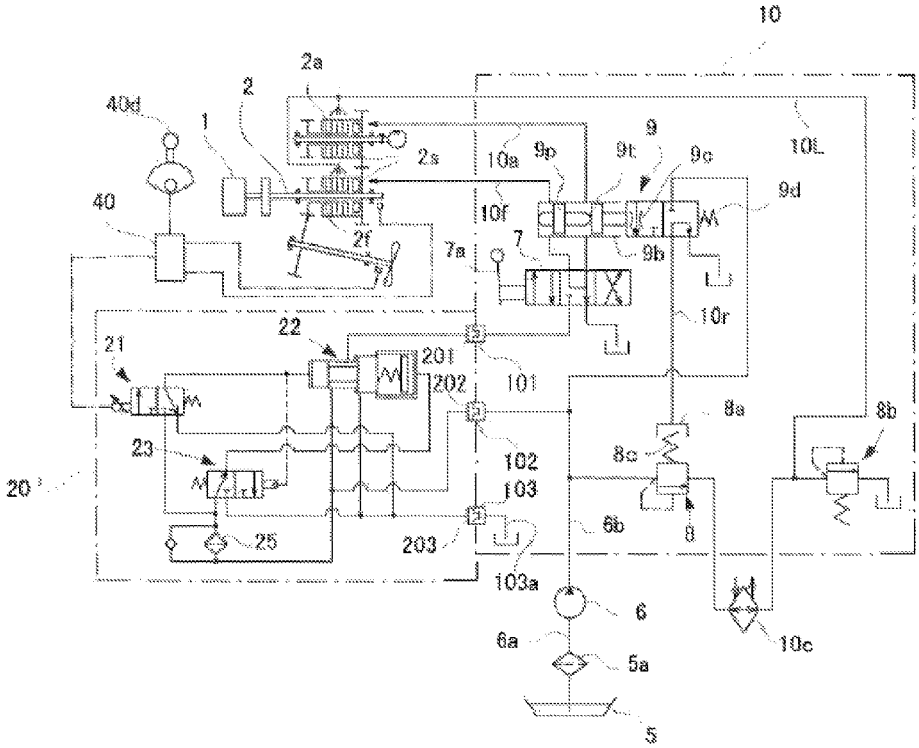
FIG. 6 is a hydraulic circuit diagram showing a modified embodiment of the hydraulic circuit of FIG. 1.

As shown in FIG. 6, a hydraulic control apparatus 20', which has a circuit configuration wherein a working oil is supplied to a proportional electromagnetic valve 21 without passing a switching valve 23, can also be employed as a hydraulic control apparatus that functions in the same manner as the hydraulic control apparatus 20.

In FIG. 6, a port 203 for a drain oil path is connected to a port 103 located in the drain oil path in the working oil supply circuit 10, and the port 103 drains the oil via the oil path 103*a*.

Alternatively, instead of using the hydraulic control apparatus 20, a cover as described below may be provided. A cover is represented by the oil circuit surrounded by the dotted and dashed line and denoted by reference numeral 50 in FIG. 1. The cover 50 has ports 501, 502 connected to ports 101, 102, respectively, of the working oil supply circuit 10; an oil path 51 that bypasses the ports 501, 502; and a port 503 that blocks the port 103 in the drain oil path. By connecting between the port 101 of the working oil supply circuit 10 and the port 501, and likewise between the port 102 and the port 502, the oil path of the working oil supply circuit 10 can bypass directly to the switching valve 7 via the pump 6. That is to say, the cover 50 is connectable to the ports 101 to 103 in the working oil supply circuit 10.

As described above, a working oil supply circuit 10 with any configuration can be applied according to the output or size of each reduction and reversing gear for watercraft.

Figure 7:
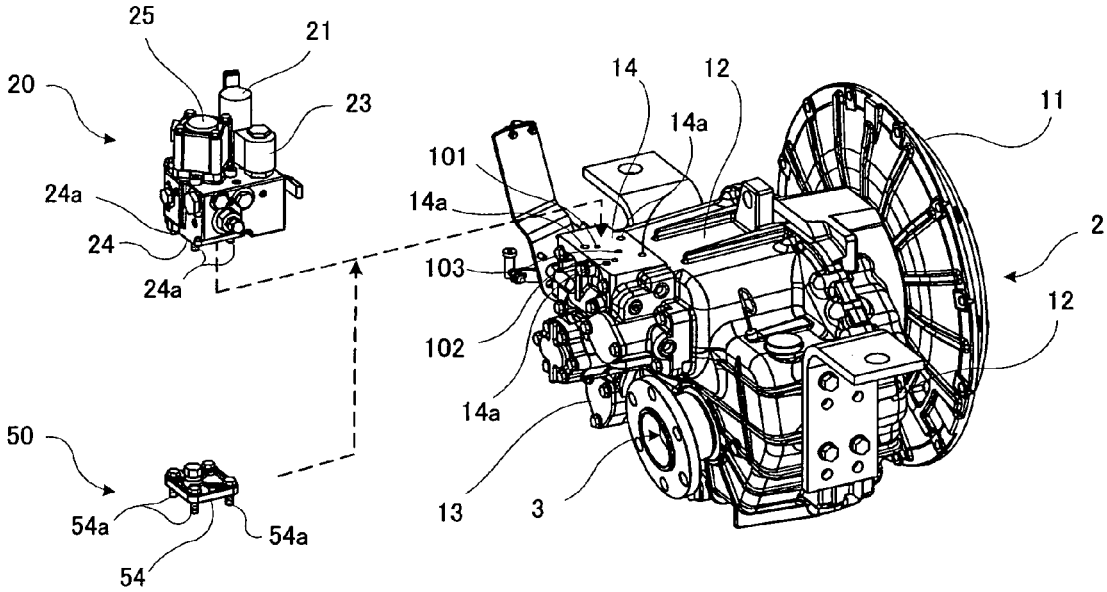
FIG. 7 is a perspective view showing the appearance of the reduction and reversing gear of FIG. 1 along with the hydraulic control apparatus.

FIG. 7 shows an external perspective view of a reduction and reversing gear for watercraft having the clutches 2*a*, 2*f* and the working oil supply circuit 10 described above, and FIG. 8(*a*) shows a vertical cross section thereof.

Figure 8:
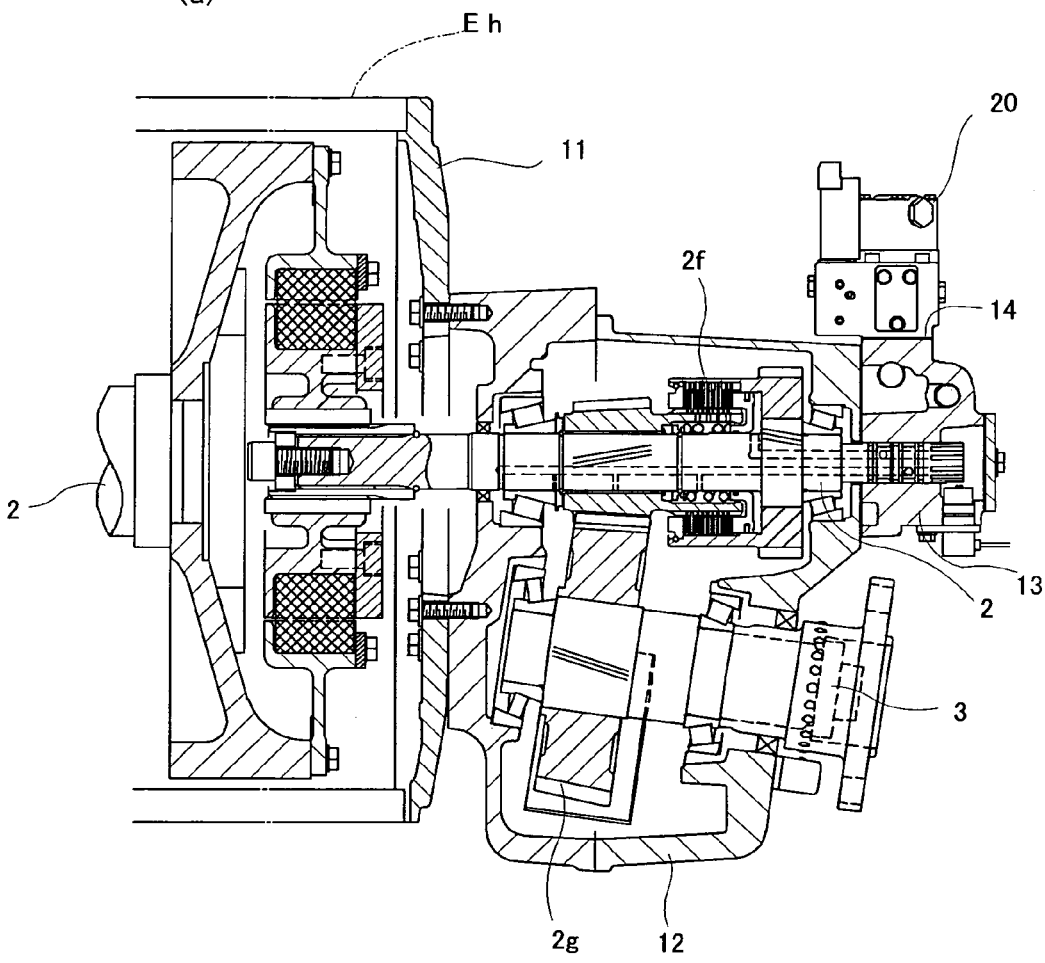
FIG. 8(*a*) is a cross section of the reduction and reversing gear of FIG. 1, and FIG. 8(*b*) is enlarged cross section of a clutch.
Figure 8:
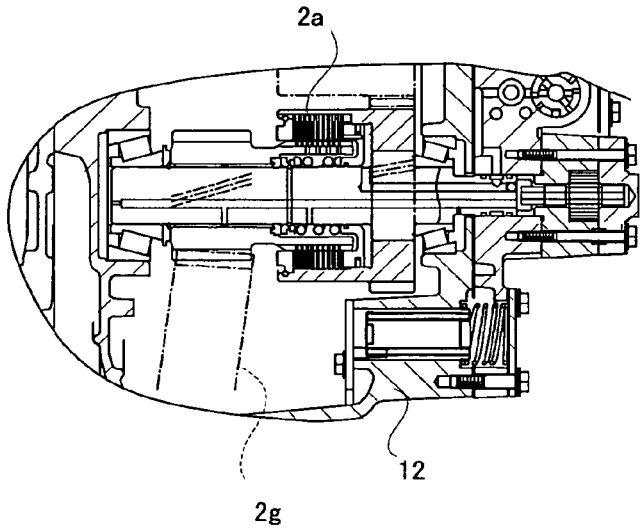

The reduction and reversing gear for watercraft includes a mounting flange 11 connected to an engine casing Eh (FIG. 8(*b*)); a gear casing 12 that houses forward and reverse clutches 2*a*, 2*f*, a gear 2*g*, and the like; and an oil path casing 13 that houses a working oil supply path 10. The engine casing Eh houses the flywheel of an engine.

The gear casing 12 is capable of being separated and joined into two elements in the axial direction (see FIG. 8(*b*)). FIG. 8(*b*) shows the joint surface between the oil path casing 13 and the gear casing 12. In FIG. 8(*b*), the oil path and the like formed on the bottom surface are indicated by the dashed line.

The forward clutch 2*f* is mounted on the input shaft 2, while the reverse clutch 2*a* is supported by a support shaft 2*b* that is supported in parallel with the input shaft 2. The reverse clutch 2*a* is partially shown in FIG. 8(*b*). The reverse clutch 2*a* engages with the large gear 2*g*.

Figure 9:
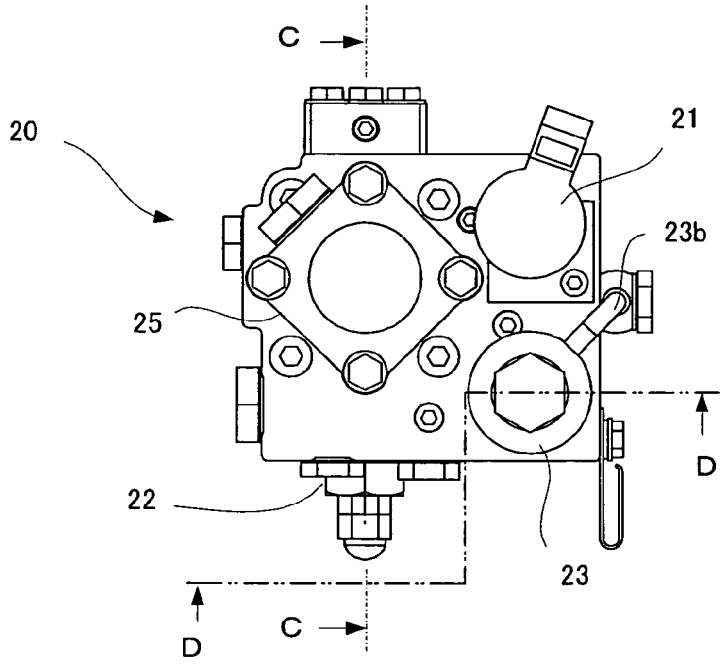
FIG. 9 is an enlarged plan view showing the hydraulic control apparatus of FIG. 7.
Figure 10:
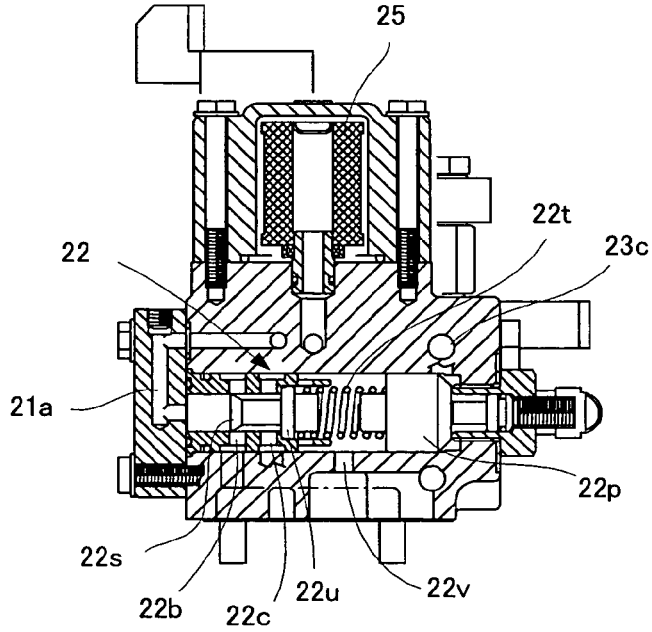
FIG. 10 is a cross section along the line C-C of FIG. 9.
Figure 11:
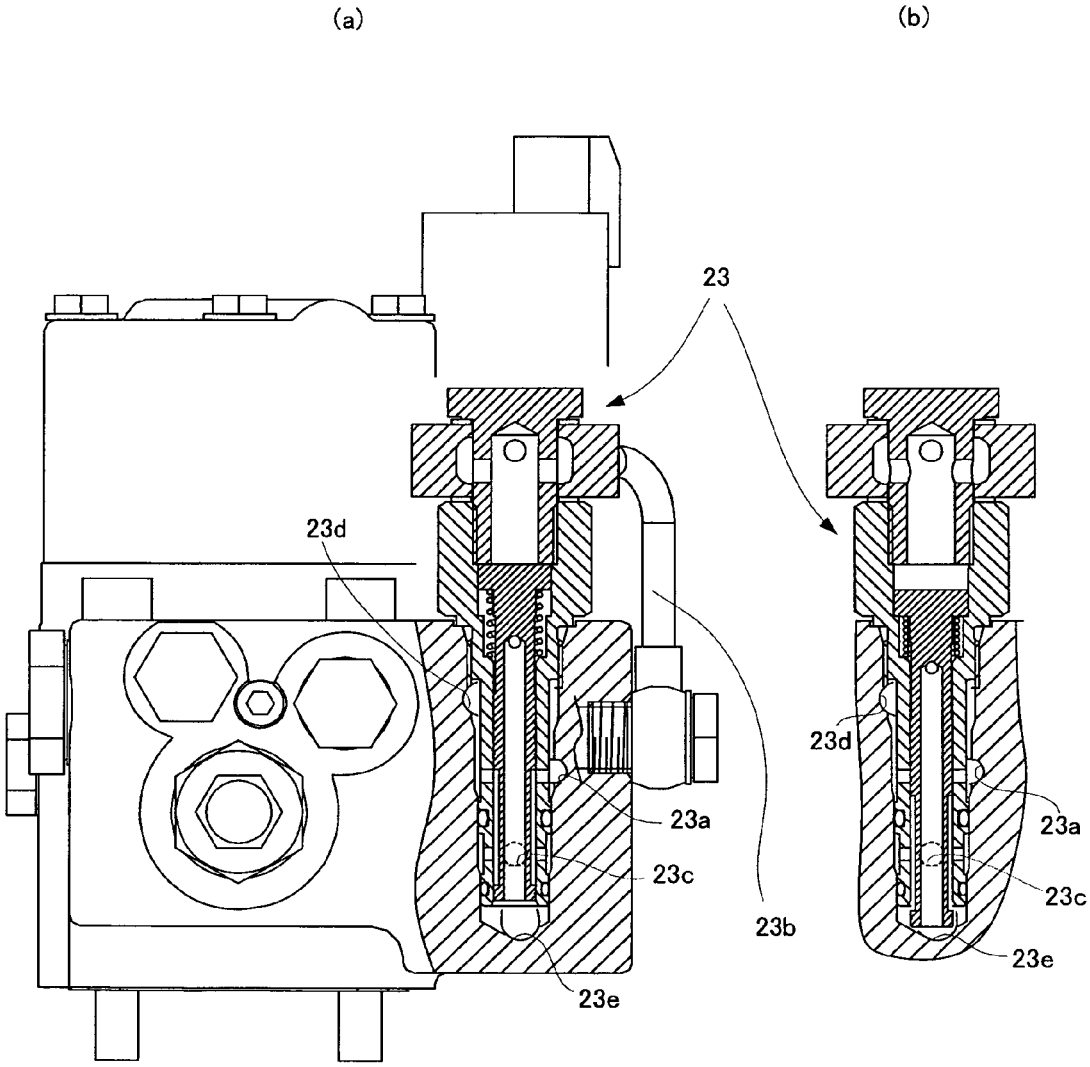
FIG. 11 is a cross section along the line D-D of FIG. 9.

FIG. 9 is an enlarged plan view showing the hydraulic control apparatus 20 shown in FIGS. 7 and 8. FIG. 10 shows a cross section along the line C-C of FIG. 9. FIG. 11 shows a cross section along the line D-D of FIG. 9. FIG. 11(*a*) is a diagram showing the state shown in FIG. 2 wherein the switching valve 23 is switched to an open position by the spring force of the switching valve 23 surpassing the pilot pressure. FIG. 11(*b*) is a diagram showing the closed state shown in FIG. 3 wherein the spring is pushed in by the pilot pressure.

In FIG. 7, reference numerals 24*a*, 54*a* denote bolts for securing the hydraulic control apparatus 20 and the cover 50, respectively, and these are fitted into female screw holes 14*a* formed in the connection surface 14 to thereby fix the connection surfaces together.

As shown in FIG. 7, the connection surface 14 is provided with openings to form a port 102, a port 101, and a drain port 103 of the working oil supply circuit 10; and as shown in FIG. 10, the connection surface 24 of the hydraulic control apparatus 20 is also provided with openings to form corresponding ports.

The connection surface 54 of the cover 50 is also provided with openings to form corresponding ports, although they are hidden under the back surface in FIG. 7. Thus, when the connection surface 24 of the hydraulic control apparatus 20 is positioned relative to the connection surface 14, and these connection surfaces are connected and fixed, the ports 201 to 203 shown in FIG. 1 are connected to the ports 101 to 103, respectively, of the working oil supply circuit 10, so that the working oil, whose oil pressure has been adjusted, is supplied to the working oil supply circuit. On the other hand, when the connection surfaces 54 of the cover 50 are connected to the connection surface 14, the ports 501 to 503 shown in FIG. 1 are connected to the ports 101 to 103, respectively, of the working oil supply circuit 10, so that the bypassed working oil is supplied to the working oil supply circuit 10.

Therefore, by replacing the hydraulic control apparatus 20 and the cover 50 with each other, the reduction and reversing gear for watercraft can be easily changed between a type provided with a trolling device (the hydraulic control apparatus 20) and a type without a trolling device. Moreover, the switching valve 23 can be configured to be exchangeable with a conventional direct-coupled electromagnetic valve to provide compatibility.

What is claimed is:

1. A hydraulic control apparatus for marine reversing gear assembly for watercraft, comprising:

a pressure reducing valve for adjusting the pressure of a working oil supplied from a working oil supply pump, and supplying the working oil to forward and reverse clutches;

a proportional electromagnetic valve for controlling the supply of the working oil to a pilot chamber of the pressure reducing valve; and a pressure-controlled spring-type switching valve for switching to a circuit for supplying the working oil to a control piston chamber for controlling a set spring force of the pressure reducing valve, or to a circuit for draining the working oil from the control piston chamber;

wherein a pressure output of the working oil supplied from the proportional electromagnetic valve acts upon the switching valve as a pilot pressure; and when the pilot pressure falls below a predetermined value, the switching valve switches to the circuit for supplying the working oil to the control piston chamber via the spring of the switching valve, and fully opens the pressure reducing valve.

2. The hydraulic control apparatus according to claim 1, wherein, when the pilot pressure to the pilot chamber from the proportional electromagnetic valve is increased, the pressure of the working oil to the forward and reverse clutches is decreased in the pressure reducing valve.

3. The hydraulic control apparatus according to claim 1, wherein, when an exciting current is not supplied to the proportional electromagnetic valve, the pilot pressure falls below the predetermined value, and the switching valve switches to the circuit for supplying the working oil to the control piston chamber via the spring, and fully opens the pressure reducing valve.

* * * * *